US006384546B2

(12) United States Patent
Nakajima

(10) Patent No.: US 6,384,546 B2
(45) Date of Patent: May 7, 2002

(54) DEFLECTION YOKE AND MIS-CONVERGENCE CORRECTION METHOD FOR COLOR CATHODE-RAY TUBE

(75) Inventor: Koji Nakajima, Shiga (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/757,624

(22) Filed: Jan. 11, 2001

(30) Foreign Application Priority Data

Jan. 13, 2000 (JP) ..... 2000-009941

(51) Int. Cl.[7] ..... H01J 29/56
(52) U.S. Cl. ..... 315/371
(58) Field of Search ..... 315/371, 370, 315/368.25

(56) References Cited

U.S. PATENT DOCUMENTS 4,818,919 A * 4/1989 Kobayashi et al. ..... 315/371

FOREIGN PATENT DOCUMENTS

JP 9-17355 1/1997
JP 11-40079 2/1999

* cited by examiner

*Primary Examiner*—David Vu
(74) *Attorney, Agent, or Firm*—McGinn & Gibb, PLLC

(57) ABSTRACT

An inline type color cathode-ray tube deflection yoke applies a deflecting magnetic field to electron beams from a neck portion of a valve accommodating three electron guns toward the funnel portion of the valve. The deflection yoke is provided with a vertical deflection coil, auxiliary coils serially connected to the vertical deflection coil, and a U-shaped magnetic member around each of both leg portions of which the auxiliary coils are wound. The U-shaped magnetic member is arranged so that the leg portions face the neck portion.

14 Claims, 9 Drawing Sheets

DEFLECTION YOKE AND MIS-CONVERGENCE CORRECTION METHOD FOR COLOR CATHODE-RAY TUBE

BACKGROUND OF THE INVENTION

1. Field of the Invention

The present invention relates to a deflection yoke attached to an inline type color cathode-ray tube and a mis-convergence correction method for a color cathode-ray tube correcting mis-convergence on the Y-axis of a screen. The present invention particularly relates to a deflection yoke and a mis-convergence correction method capable of simultaneously correcting comatic aberration and mis-convergence.

2. Description of the Related Art

There exists a color display device provided with an inline type color cathode-ray tube (to be referred to as "color CRT" hereinafter). In the inline type color CRT, electron beams are produced in a vacuum valve from electron guns for blue, green, and red, respectively. The electron beams are deflected in X and Y-axes directions by a deflection yoke made up of an electromagnetic coil and the like and reach a phosphor film through a shadow mask.

In the inline type color CRT stated above, electron beams pass into a heavily distorted deflecting magnetic field at the time of deflecting the electron beams in the X and Y-axes directions by means of the deflection yoke. Due to this, three electron beams disadvantageously, poorly converge. This phenomenon is called mis-convergence.

To solve the disadvantage, there is provided a color CRT which adopts a system called inline self-convergence system. FIGS. 1A and 1B are typical views showing the inline self-convergence system. In the inline self convergence system, a deflecting magnetic field 101 (FIG. 1A) having a pin cushion type, horizontally deflecting magnetic field distribution, and a deflecting magnetic field 102 (FIG. 2B) having a barrel type, vertically deflecting magnetic field distribution are formed. Three electron beams 10B, 10G and 10R emitted from three inline electron guns aligned in the same horizontal plane are deflected by these deflecting magnetic fields 101 and 102 and converge at arbitrary points on a screen, respectively.

The inline self-convergence system has advantages in that it suffices to provide a small number of electrical circuits, adjustment is required infrequently and the like to converge the three electron beams 10B, 10G and 10R and in that the highly accurate convergence can be realized.

Nevertheless, a focus voltage Vfh capable of minimizing a horizontal diameter of a spot and a focus voltage Vfv capable of minimizing a vertical diameter of a spot differ from each other and the difference between the both focus voltages $\Delta Vf = Vfh - Vfv$ is negative. Namely, the convergence state of the electron beams in the vertical direction is an over-focus state. For that reason, if the distortions of the shapes of the electron beams on the periphery of the screen are finely observed, it is found that halos occur in vertical direction because of astigmatism. FIG. 2 is a typical view showing electron beam spots on a conventional screen. Electron beams 10B, 10G and 10R are influenced by the magnetic field distortions of the self convergence deflecting magnetic fields 101 and 102 when passing into the fields 101 and 102. As a result, the shapes of the electron beam spots become round at the center of the screen, which is free from deflection. However, if the electron beams are deflected to the peripheral portions of the screen, the shape of each electron beam spot becomes one having an oblong beam core 111 and a radial halo 112 generated above and below the beam core 111, i.e., a distorted shape. The diameter of each of the distorted electron beam spots on the peripheral portions of the screen is, therefore, larger than that of the completely round spot at the center of the screen, with the result that resolution on the peripheral portions of the screen considerably deteriorates.

Further, because of the asymmetry of deflecting magnetic fields, comatic aberration, which causes mis-convergence occurring between the center beam (G) and the side beams (B, R) among the three electron beams as deflection frequency is higher. It is, therefore, necessary to eliminate the comatic aberration, as well. FIGS. 3A to 3D are typical views showing mis-convergence. FIG. 4 is a typical view showing one example of a lateral raster distortion. The mis-convergence caused by the comatic aberration includes an arc distortion, as shown in FIG. 3A, in which a red line 20R and a blue line 20B separate from each other in lateral direction on the upper and lower ends of the screen, a distortion, as shown in FIG. 3B, in which a red line 21R and a blue line 21G separate from each other in longitudinal direction on the upper and lower ends of the screen, and a distortion, as shown in FIG. 3C, in which a red line 21R and a blue line 21B separate from a green line 21G in longitudinal direction. Further, as shown in FIG. 3D, if a figure which should be originally a rectangle is distorted into a trapezoid 30 due to the influence of a pin cushion type magnetic field distribution and a barrel type magnetic field distribution, the distorted figure is visually inappropriate particularly for CAD, CAM or the like and causes much deficiency. Moreover, as shown in FIG. 4, if there is a parallel distortion in which a red line 21R and a blue line 21B are deviated from a green line 21G in the lateral direction of the screen, a resultant image is difficult to view.

The mis-convergence stated above is normally considered to derive from the deviation between the mechanical center of three electron beams and that of a deflecting magnetic field from the viewpoint of the electron guns of a color CRT. Further, the mis-convergence is considered to derive from a design in which a variable resistor for deflecting current control provided on a deflection coil simultaneously corrects comatic aberration and the distortion of an image from the viewpoint of a deflection yoke.

To solve the above-stated disadvantages, there has been conventionally proposed a mis-convergence correction method using a deflection yoke provided with a pair of E-shaped magnetic members (Japanese Patent Application Laid-Open No. 9-17355). FIG. 5 is a typical view showing a conventional deflection device disclosed by Japanese Patent Application Laid-Open No. 9-17355. FIG. 6 is a typical view showing magnetic fields generated by the conventional deflection device.

This conventional deflection device has a pair of E-shaped magnetic members 41 and 42 provided on a deflection yoke bobbin attached to the neck portion 40 of a color CRT. Coma correction coils 51*a* and 51*c* are wound around the leg portions 41*a* and 41*c* of the E-shaped magnetic member 41 on both ends thereof, respectively. A coma correction coil 51*b* is wound around the central leg portion 41*b* of the E-shaped magnetic member 41. Likewise, coma correction coils 52*a* and 52*c* are wound around the leg portions 42*a* and 42*c* of the E-shaped magnetic member 42 on the both ends thereof, respectively. A coma correction coil 52*b* is wound around the central leg portion 42*b* of the E-shaped magnetic member 42.

In the conventional deflection device constituted as stated above, a pin cushion type deflecting magnetic field 60*a* is generated between the leg portions 41*a* and 42*a,* and a pin cushion type deflecting magnetic field 60*c* is generated between the leg portions 41*c* and 42*c* as shown in FIG. 6. A barrel type deflecting magnetic field 61*b* is generated between the leg portions 41*b* and 42*b*. As a result, astigmatism and mis-convergence can be simultaneously corrected.

Although the conventional mis-convergence correction method stated above has an advantage in that astigmatism and mis-convergence can be simultaneously corrected by simple means relatively easily, the following disadvantages are still to be solved.

Since three coma correction coils are provided for each E-shaped magnetic member, the mold structure of a supporter for an E-shaped magnetic member becomes complicated. Consequently, production cost is increased and it is economically difficult to work this method.

Furthermore, as shown in FIG. 4, while the horizontal deviation between the red line 21R and the blue line 21B, and the green line 21G on the upper and lower ends of the screen are small, the vertical deviation between the red line 21R and the blue line 21B, and the green line 21G on the left and right ends of the screen is large. For that reason, there is a fundamental limit to correcting deviations.

Moreover, as shown in, for example, Japanese Patent Application Laid-Open No. 11-40079, an E-shaped magnetic member is to be arranged on the electron gun-side rear end portion of a deflection yoke. FIG. 7 is a typical view showing how the E-shaped magnetic member is disposed. FIG. 8 is a typical view showing mis-convergence resulting from asymmetry of magnetic flux densities. The arrangement shown therein is undesirable from the viewpoint of the structure of the deflection yoke for the following reasons. As shown in FIG. 7, a low hysteresis, high permeable magnetic member 74 is normally attached to a bobbin 73 while intersecting a leakage magnetic flux from a horizontal deflection coil 72 on the rear end portion of the deflection yoke 70 on an electron gun 71 side. This is intended to correct mis-convergence generated because the magnetic flux distribution densities of lines 22G, 22B and 22R become asymmetric on the left and right positions of a screen as shown in FIG. 8. In case of employing the E-shaped magnetic member, therefore, such a mis-convergence correction method cannot be adopted.

In these circumstances, a mis-convergence correction method other than a method of providing a coma correction coil on an E-shaped magnetic body is desired.

SUMMARY OF THE INVENTION

It is, therefore, an object of the present invention to provide a deflection yoke and a mis-convergence correction method for a color cathode-ray tube which can be manufactured at low cost and which can ensure the correction of both astigmatism and mis-convergence.

According to one aspect of the present invention, a deflection yoke for inline type color cathode-ray tube with a valve accommodating three electron guns and having a neck portion and a funnel portion comprises a vertical defection coil which defects beams emitted from the three electron guns in a vertical direction of a screen, auxiliary coils connected in series to the vertical deflection coil, and a U-shaped magnetic member having leg portions and being arranged such that the leg portions face the neck portion of the valve. The auxiliary coils are wound around each of the leg portions of the U-shaped magnetic member.

In the present invention, the auxiliary coils wound around the U-shaped magnetic member are connected to the vertical deflection coil in series. Therefore, a quadruple magnetic field lens function resulting from a type of quadruple coils is generated. As a result, a pin cushion distortion in the vertical direction of a screen can be corrected and mis-convergence can be corrected, as well.

According to another aspect of the present invention, a mis-convergence correction method for a color cathode-ray tube provided with the above-described deflection yoke, the method comprises the step of adjusting each of inductances of the auxiliary coils.

DESCRIPTION OF THE PREFERRED EMBODIMENTS

Figure 1A:
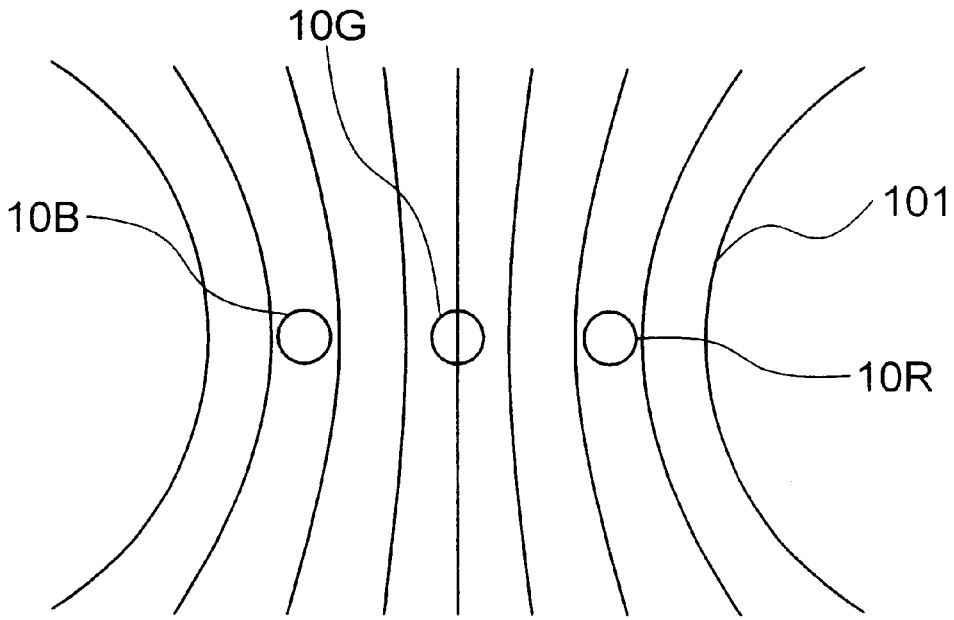
FIG. 1A (PRIOR ART)
FIGS. 1A and 1B are typical views showing an inline self-convergence system.
Figure 1B:
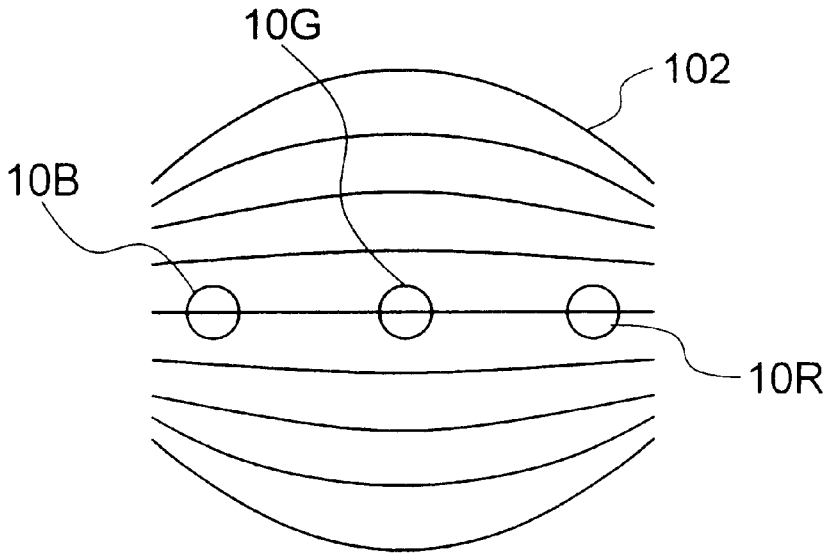
FIG. 1B (PRIOR ART)
Figure 2:
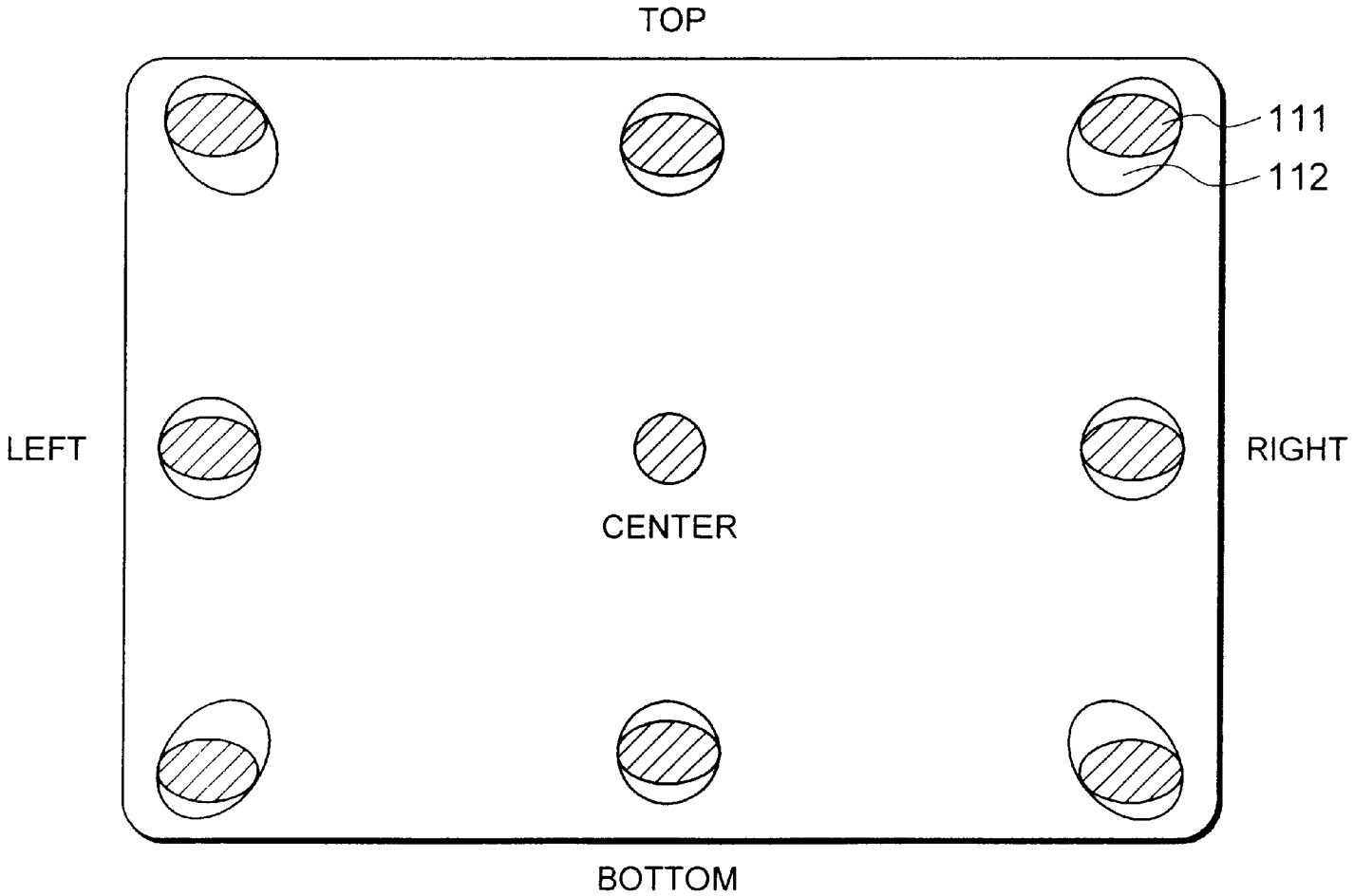
FIG. 2 (PRIOR ART)
FIG. 2 is a typical view showing electron beam spots on a conventional screen.
Figure 3A:
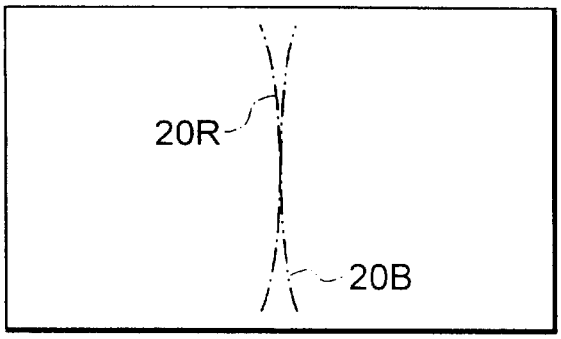
FIG. 3A (PRIOR ART)
FIGS. 3A to 3D are typical views showing mis-convergence.
Figure 3B:
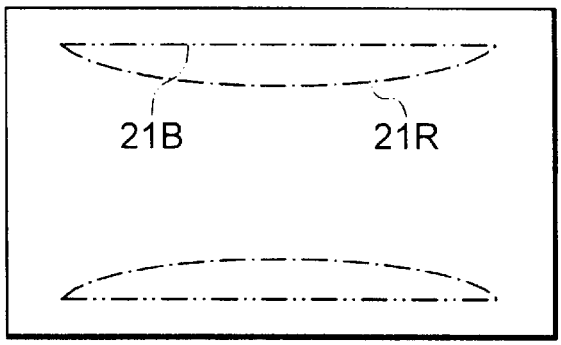
FIG. 3B (PRIOR ART)
Figure 3C:
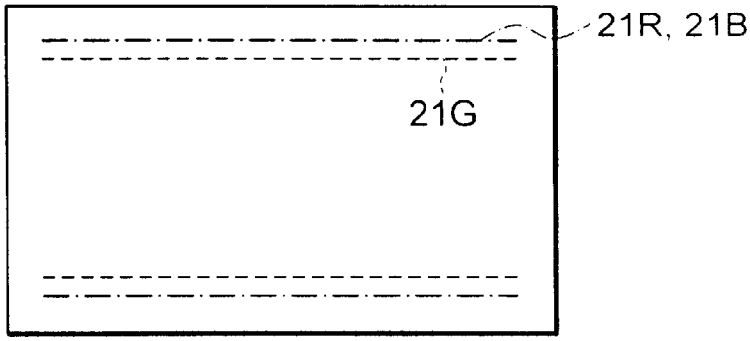
FIG. 3C (PRIOR ART)
Figure 3D:
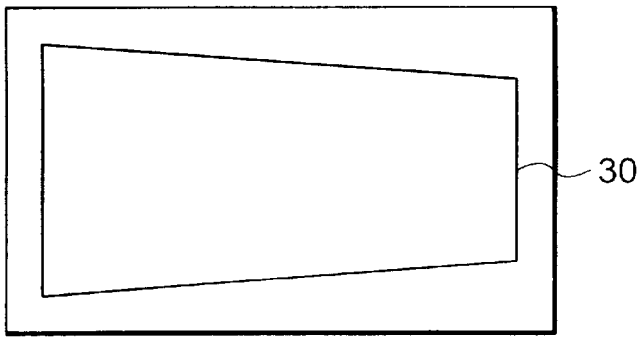
FIG. 3D (PRIOR ART)
Figure 4:
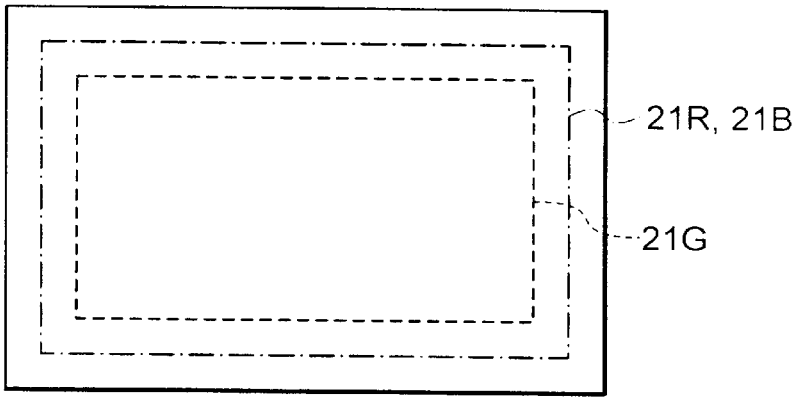
FIG. 4 (PRIOR ART)
FIG. 4 is a typical view showing one example of lateral raster distortions.
Figure 5:
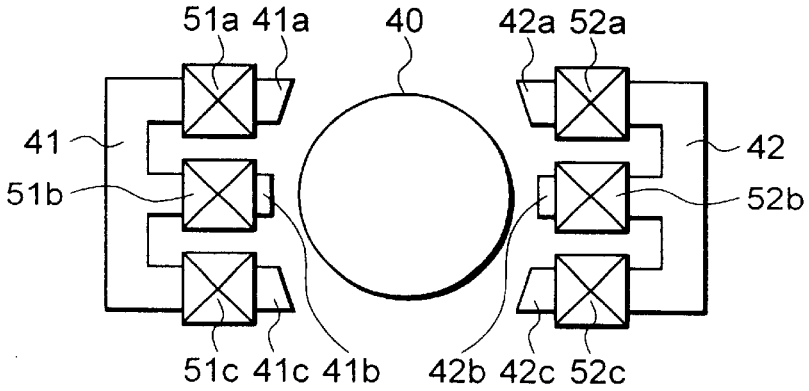
FIG. 5 (PRIOR ART)
FIG. 5 is a typical view showing a conventional deflection device disclosed by Japanese Patent Application Laid-Open No. 9-17355.
Figure 6:
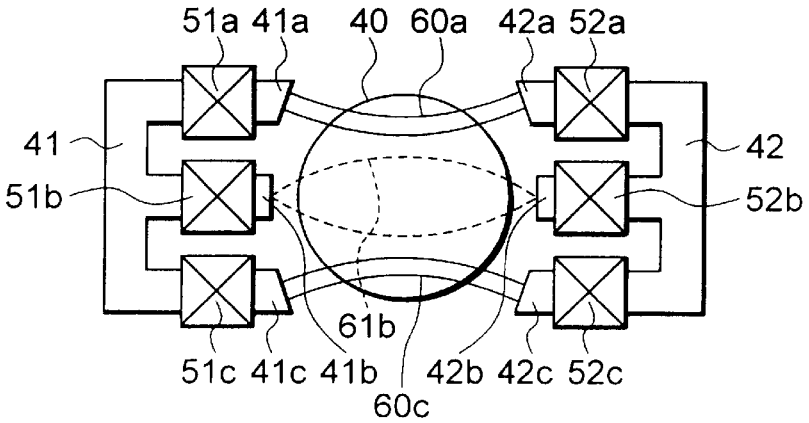
FIG. 6 (PRIOR ART)
FIG. 6 is a typical view showing magnetic fields generated by the conventional deflection device.
Figure 7:
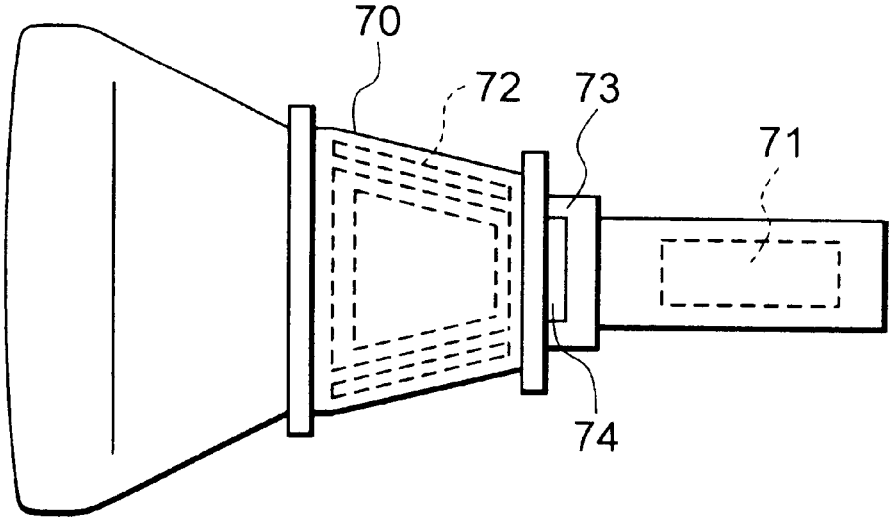
FIG. 7 (PRIOR ART)
FIG. 7 is a typical view showing a disposing place where an E-shaped magnetic member is disposed.
Figure 8:
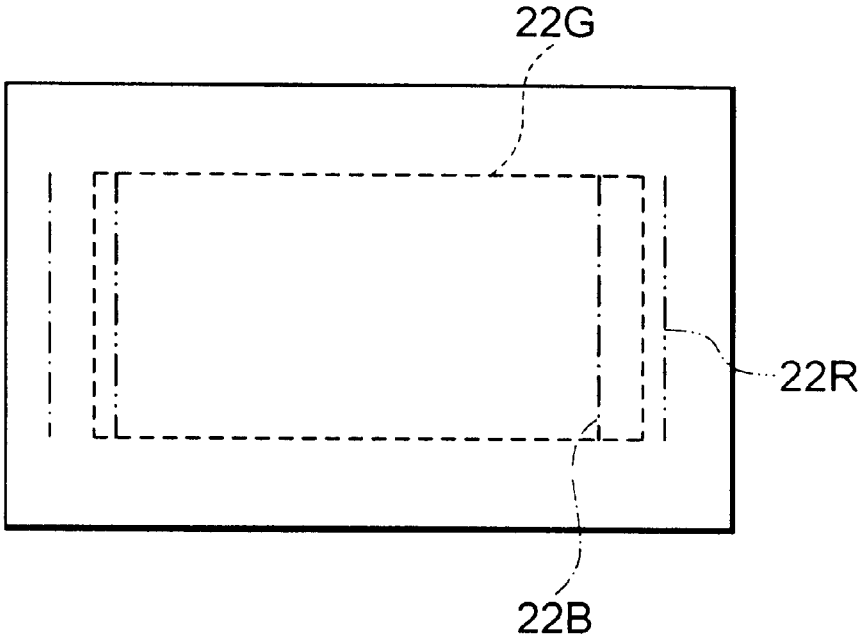
FIG. 8 (PRIOR ART)
FIG. 8 is a typical view showing mis-convergence derived from asymmetry of magnetic flux densities.
Figure 9:
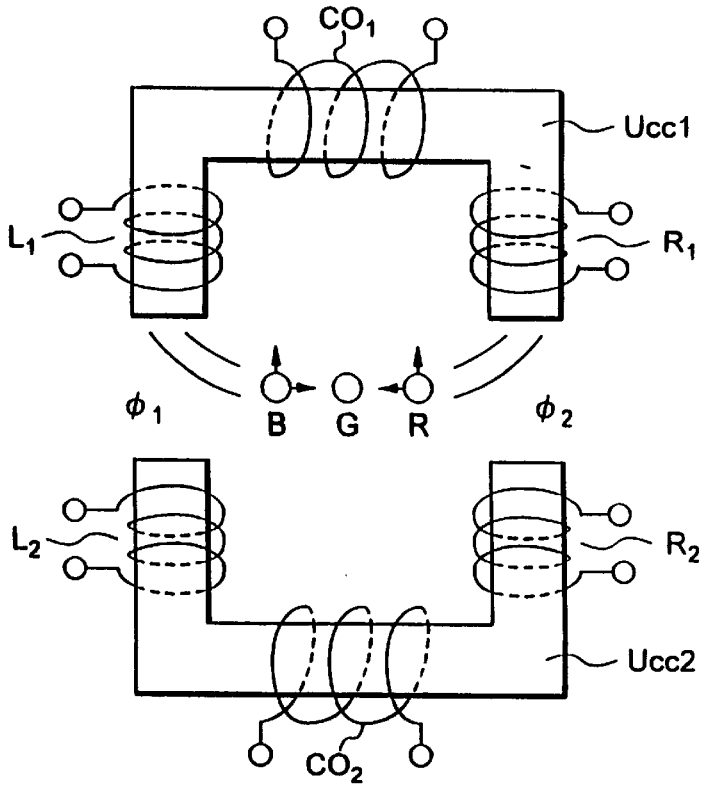
FIG. 9 is a front view showing a deflection yoke in a first embodiment according to the present invention.
Figure 10:
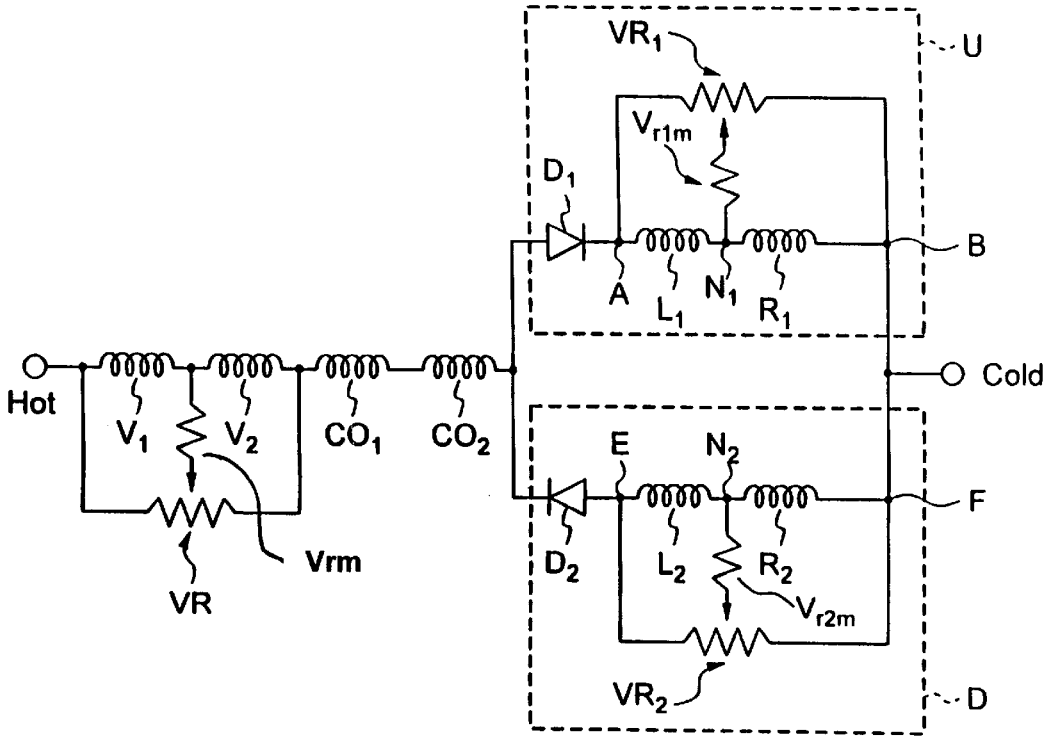
FIG. 10 is a circuit diagram showing connecting relation among coils in the first embodiment.

The preferred embodiments of the present invention will be concretely described hereinafter with reference to the accompanying drawings. FIG. 9 is a front view showing a deflection yoke in a first embodiment according to the present invention. FIG. 10 is a circuit diagram showing connecting relation among coils in the first embodiment.

In the first embodiment, two U-shaped magnetic members Ucc1 and Ucc2 are provided. The U-shaped magnetic members Ucc1 and Ucc2 are arranged so as to put the neck portion (not shown) of a color CRT between the both tip ends of the respective leg portions of the U-shaped magnetic members Ucc1 and Ucc2. An upper left auxiliary coil L1 and an upper right auxiliary coil R1 are wound around the leg portions of the U-shaped magnetic member Ucc1, respectively, and a coma correction coil CO1 is wound around the central portion of the member Ucc1. Likewise, a lower left auxiliary coil L2 and an lower right auxiliary coil R2 are wound around the leg portions of the U-shaped magnetic member Ucc2, respectively, and a coma correction coil CO2 is wound around the central portion of the member Ucc2.

Further, in the first embodiment, vertical coils V1 and V2 are connected in series to a deflection coil terminal Hot. A variable resistor VR for deflecting current control is connected in parallel to the vertical coils V1 and V2. A contact Vrm of the variable resistor VR is connected to the node between the vertical coils V1 and V2. On the upper half of a screen, electron beams are deflected in vertical direction by the vertical coil V1. On the lower half of the screen, electron beams are deflected in vertical direction by the vertical coil V2. Further, the coma correction coils CO1 and CO2 are connected in series to the vertical coil V2. In addition, correction coil bodies U and D are connected parallel to each other between the coma correction coil CO2 and a deflection coil terminal Cold.

In the correction coil body U, a rectifier diode D1, the upper left auxiliary coil L1 and the upper right auxiliary coil R1 are connected in series between the coma correction coil CO2 and the deflection coil terminal Cold. The rectifier diode D1 is arranged such that the anode of the diode D1 is connected to the coma correction coil CO2. Further, the both ends of a variable resistor VR1 are connected to the node A between the diode D1 and the upper left auxiliary coil L1 and the terminal Cold-side terminal B of the upper right auxiliary coil R1, respectively. A contact Vr1m of the variable resistor VR1 is connected to the node N1 between the upper left auxiliary coil L1 and the upper right auxiliary coil R1. The correction coil body U constituted as stated above corrects a lateral raster distortion of an image on the upper half of the screen.

In the correction coil body D, a rectifier diode D2, the lower left auxiliary coil L2 and the lower right auxiliary coil R2 are connected in series between the coma correction coil CO2 and the deflection coil terminal Cold. The rectifier diode D2 is arranged such that the cathode of the diode D2 is connected to the coma correction coil CO2. Further, the both ends of a variable resistor VR2 are connected to the node E between the diode D2 and the lower left auxiliary coil L2 and the terminal Cold-side terminal F of the lower right auxiliary coil R2, respectively. A contact Vr2m of the variable resistor VR2 is connected to the node N2 between the lower left auxiliary coil L2 and the lower right auxiliary coil R2. The correction coil body D constituted as stated above corrects a lateral raster distortion of the image on the lower half of the screen.

Figure 11:
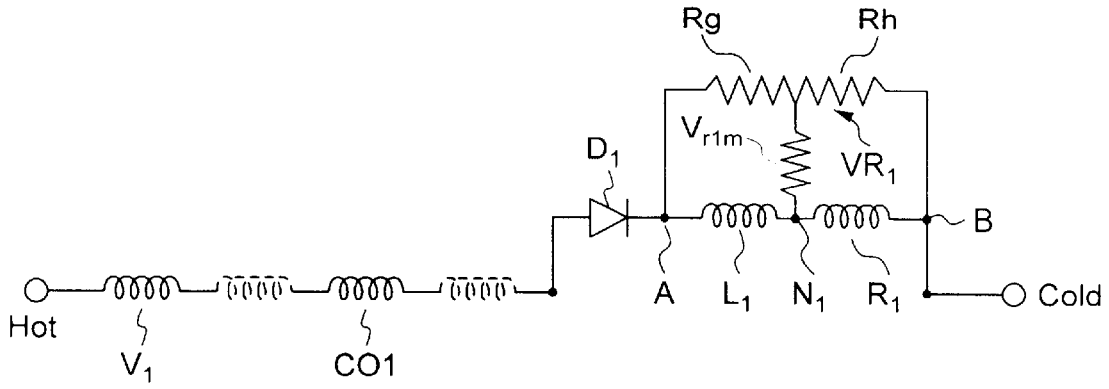
FIG. 11 is a circuit diagram showing a method of creating an image on the upper half of a screen in the first embodiment.

Next, the operation of the deflection yoke constituted as stated above in the first embodiment will be described. FIG. 11 is a circuit diagram showing a method of creating an image on the upper half of the screen in the first embodiment.

If the image on the upper half of the screen is created by vertical deflection, a saw-tooth deflecting current is applied by a vertical deflection circuit (not shown) from the deflection coil terminal Hot toward the deflection coil terminal Cold. As a result, the vertical deflection is conducted only by the vertical coil V1 in a vertical deflecting portion of the deflection yoke. Also, while a current flows in the correction coil body U, no current flows in the correction coil body D, by the rectification functions of the diodes D1 and D2. Accordingly, electron beams are closer to and greatly influenced by the vertical coil V1 and the coma correction coil CO1, but hardly influenced by the vertical coil V2 and the coma correction coil CO2. The vertical coil V2 and the coma correction coil CO2 may be considered to be substantially short-circuited as indicated by broken lines in FIG. 11.

Next, the vertical deflection operation on the upper half of the screen will be described in more detail. First, the power of the color CRT is turned on, electron beams are emitted from electron guns, the electron beams are struck against a phosphor film on the inner surface of a face portion through the deflection yoke and a shadow mask, thereby forming a raster (which means an image). In the correction coil body U, a bridge circuit is made up out of divisional resistors Rg and Rh of the variable resistor VR1, the upper left auxiliary coil L1 and the upper right auxiliary coil R1. The ratio of a current flowing in the upper left auxiliary coil L1 to that flowing in the upper right auxiliary coil R1 is, therefore, determined by the potential division ratio of the divisional resistors Rg and Rh. Thus, by adjusting resistance values of the divisional resistors Rg and Rh, it is possible to adjust outline of individual small beam spots.

Figure 12A:
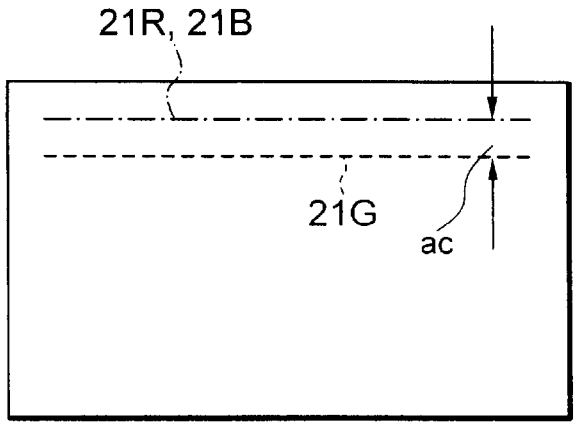
FIGS. 12A and 12B are typical views showing lateral raster distortions in the first embodiment.
Figure 12B:
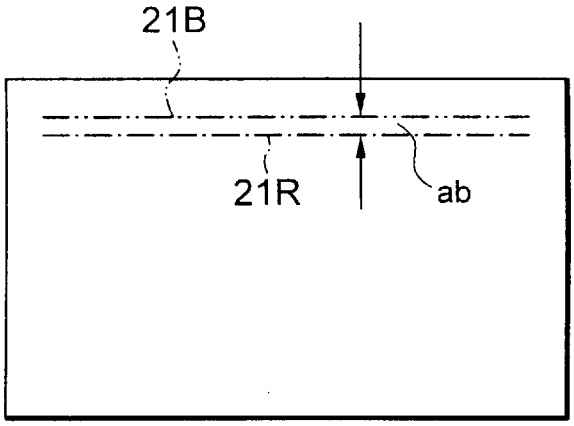

FIGS. 12A and 12B are typical views showing lateral raster distortions in the first embodiment. A distortion quantity ac between a red line 21R and a blue line 21B, and a green line 21G, and a distortion quantity ac between the red line 21R and the blue line 21B vary according to the resistance values of the divisional resistors Rg and Rh and the inductances of the upper left auxiliary coil L1 and the upper right auxiliary coil R1. Therefore, fine adjustments can be made to these distortion quantities by the contact VR1m of the variable resistor VR1 and the divisional resistors Rg and Rh. That is to say, the currents flowing in the upper left auxiliary coil L1 and the upper right auxiliary coil R1 generate magnetic fluxes $\Phi 1$ and $\Phi 2$ in the vicinity of the both end portions of the U-shaped magnetic member Ucc1, respectively, whereby the vertical positions of the individual electron beams B and R can be corrected.

Further, the variable resistor VR for deflecting current control can correct a trapezoidal image distortion independently of the correction of comatic aberration as in the case of the conventional method.

In case of creating an image on the lower half of the screen by vertical deflection, saw-tooth deflecting current may be applied by the vertical deflection circuit from the deflection coil terminal Cold toward the deflection coil terminal Hot. As a result, a comatic aberration and an image distortion can be corrected in the same manner as that on the upper half of the screen. It should be noted, however, that distortion quantities are not always the same as those in the case of the vertical deflection on the upper half of the screen. In most cases, distortion quantities differ between the upper half and the lower half of the screen. It is, therefore, preferable to change settings for the diode D2, the lower left auxiliary coil L2, the lower right auxiliary coil R2, the variable resistor VR2 and the like.

As can be seen from the above, according to the first embodiment of the present invention, a quadruple magnetic field lens may be composed of comatic aberration magnetic fields generated from the coma correction coils CO1 and CO2 wound around the U-shaped magnetic members Ucc1 and Ucc2 and the magnetic fluxes Φ1 and Φ2 generated in the vicinity of the both ends of the U-shaped magnetic members Ucc1 and Ucc2 and the like. This quadruple magnetic field lens enables the correction of mis-convergence.

Figure 13:
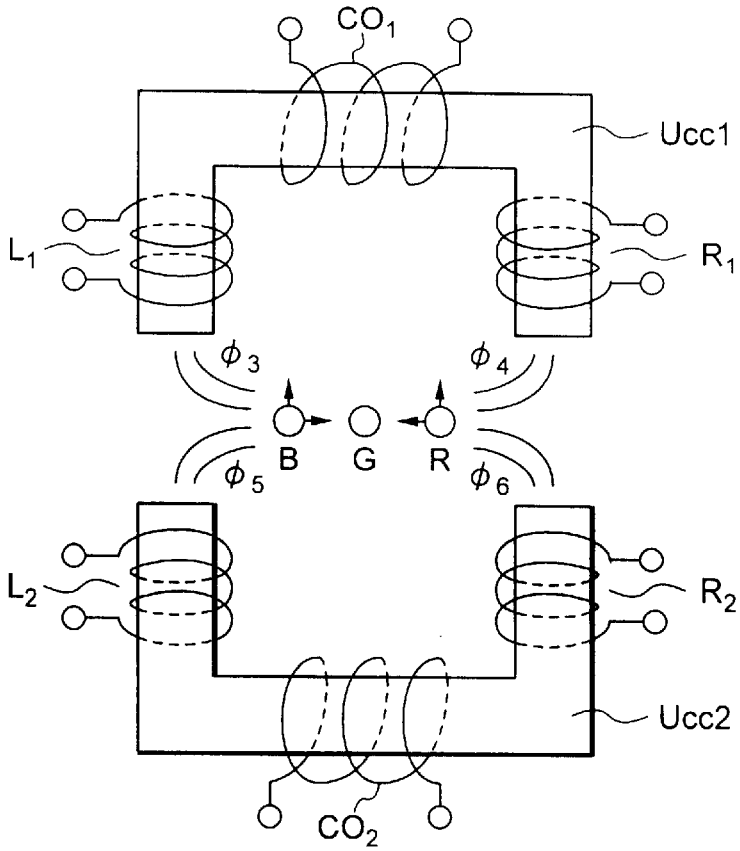
FIG. 13 is a front view showing a deflection yoke in a second embodiment according to the present invention.
Figure 14:
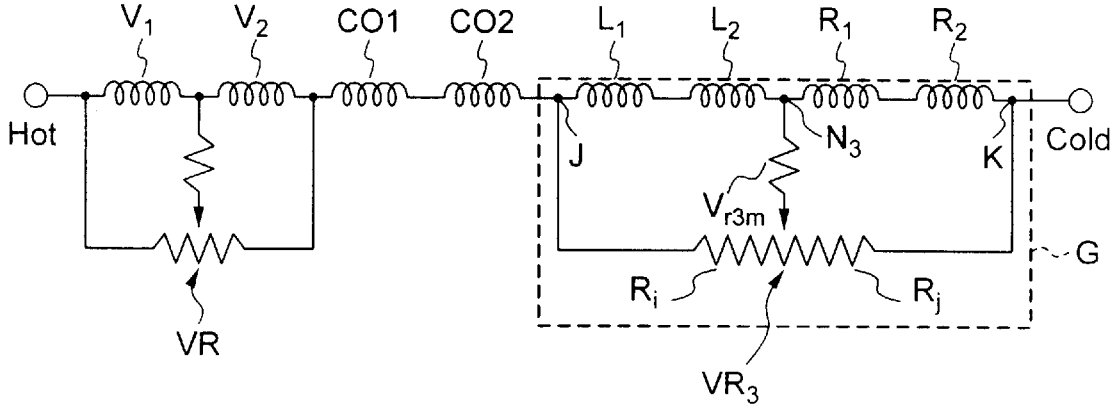
FIG. 14 is a circuit diagram showing connecting relation among coils in the second embodiment.

Next, the second embodiment according to the present invention will be described. FIG. 13 is a front view of a deflection yoke in the second embodiment according to the present invention. FIG. 14 is a circuit diagram showing connecting relation among coils in the second embodiment.

In the second embodiment, as in the case of the first embodiment, an upper left auxiliary coil L1, an upper right auxiliary coil R1 and a coma correction coil CO1 are wound around a U-shaped magnetic member Ucc1. A lower left auxiliary coil L2, a lower right auxiliary coil R2 and a coma correction coil CO2 are wound around a U-shaped magnetic member Ucc2.

Further, as in the case of the first embodiment, vertical coils V1 and V2, a variable resistor VR and the coma correction coils CO1 and CO2 are connected to a deflection coil terminal Hot. In the second embodiment, however, one correction coil body G is connected between the coma correction coil CO2 and a deflection coil terminal Cold.

In the correction coil body G, the upper left auxiliary coil L1, the lower left auxiliary coil L2, the upper right auxiliary coil R1 and the lower right auxiliary coil R2 are connected in series between the coma correction coil CO2 and the deflection coil terminal Cold in this order. Also, a variable resistor VR3 is connected in parallel to these four coils. Namely, one end of the variable resistor VR3 is connected to the node J between the coma correction coil CO2 and the upper left auxiliary coil L1, and the other end thereof is connected to the terminal Cold-side terminal K of the lower right auxiliary coil R2. A contact Vr3m of the variable resistor VR3 is connected to the node N3 between the lower left auxiliary coil L2 and the upper right auxiliary coil R1.

In other words, in the second embodiment, the correction coil body G, instead of the correction coil bodies U and D in the first embodiment, is connected between the deflection coil terminals Hot and Cold and connected in series to the vertical coils V1, V2 and the coma correction coils CO1 and CO2, as shown in FIG. 14.

Figure 15:
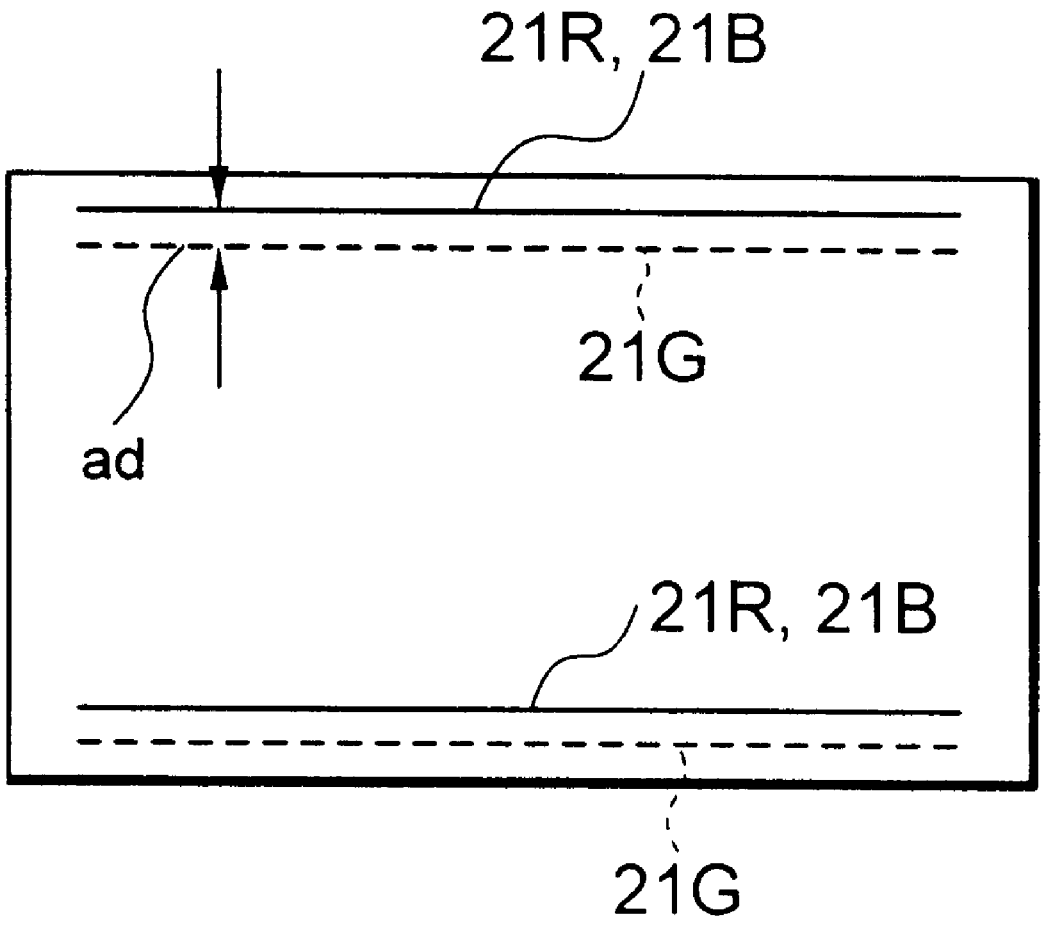
FIG. 15 is a typical view showing lateral raster distortions in the second embodiment.

Next, the operation of the deflection yoke in the second embodiment constituted as stated above will be described. In the second embodiment, the screen is not vertically divided and the entire screen is collectively subjected to vertical deflection. FIG. 15 is a typical view showing lateral raster distortions in the second embodiment.

In the second embodiment, the variable resistor VR3 is divided into divisional resistors Ri and Rj by the contact Vr3m. The divisional resistors Ri and Rj, the upper left auxiliary coil L1, the lower left auxiliary coil L2, the upper right auxiliary coil R1 and the lower right auxiliary coil R2 constitute four side resistors of a bridge circuit as a whole.

Therefore, currents flowing in the upper left auxiliary coil L1, the lower left auxiliary coil L2, the upper right auxiliary coil R1 and the lower right auxiliary coil R2 are simultaneously determined by a potential division ratio determined by the divisional resistors Ri and Rj. As a result, as shown in FIG. 13, magnetic fluxes Φ3 and Φ5 are generated by the currents flowing in the upper left auxiliary coil L1 and the lower left auxiliary coil L2, respectively, and magnetic fluxes Φ4 and Φ6 are generated by the currents flowing in the upper right auxiliary coil R1 and the lower right auxiliary coil R2, respectively. A quadruple magnetic field lens function by these magnetic fluxes Φ3, Φ4, Φ5 and Φ6 is exerted to the electron beams B and R on the both sides. Accordingly, as shown in FIG. 15, a distortion quantity ad between a red line 21R and a blue line 21B, and a green line 21G can be simultaneously corrected.

As can be understood from the above, according to the second embodiment, the distortion quantity ad can be simultaneously corrected on the entire screen, compared with the first embodiment. It is noted, however, that the first embodiment is excellent to the second embodiment in correction accuracy.

As stated so far, according to the deflection yoke and the mis-convergence method for a color CRT of the present invention, it is possible to obtain the quadruple magnetic field lens function derived from auxiliary coils by using the U-shaped magnetic member instead of the E-shaped magnetic member. It is, therefore, possible to correct lateral raster distortion independently of the correction of image distortion. This can ensure the correction of excessive mis-convergence on the vertical deflection portion of the deflection yoke in the Y-axis direction of the screen. Besides, since the U-shaped magnetic member can be also used together with the existing magnetic member for coma correction coils, it is possible to suppress the increase of production cost. Thus, the present invention is economically excellent, as well.

What is claimed is:

1. A deflection yoke for inline type color cathode-ray tube with a valve accomodating three electron guns and having a neck portion and a funnel portion comprising:

a vertical deflection coil which deflects beams emitted from said three electron guns in a vertical direction of a screen;

auxiliary coils connected in series to said vertical deflection coil; and a U-shaped magnetic member having leg portions and being arranged such that said leg portions face said neck portion of said valve, said auxiliary coils being wound around each of said leg portions of said U-shaped magnetic member.

2. The deflection yoke according to claim 1, wherein self-convergence is conducted by said deflection yoke.

3. The deflection yoke according to claim 1, wherein a deflecting magnetic field is applied from said neck portion toward said funnel portion of said valve by said deflection yoke.

4. The deflection yoke according to claim 2, wherein a deflecting magnetic field is applied from said neck portion toward said funnel portion of said valve by said deflection yoke.

5. The deflection yoke according to claim 1, further comprising a coma correction coil connected between said vertical deflection coil and said auxiliary coils.

6. The deflection yoke according to claim 5, wherein said coma correction coil is wound around a central portion of said U-shaped magnetic member.

7. The deflection yoke according to claim 1, further comprising a variable resistor which connects parallel to said auxiliary coils, a contact of said variable resistor being connected to a node between said auxiliary coils.

8. A mis-convergence correction method for a color cathode-ray tube provided with said deflection yoke according to claim 1, the method comprising the step of:

adjusting each of inductances of said auxiliary coils.

9. A mis-convergence correction method for a color cathode-ray tube provided with said deflection yoke according to claim 2, the method comprising the step of:

adjusting each of inductances of said auxiliary coils.

10. A mis-convergence correction method for a color cathode-ray tube provided with said deflection yoke according to claim 3, the method comprising the step of:

adjusting each of inductances of said auxiliary coils.

11. A mis-convergence correction method for a color cathode-ray tube provided with said deflection yoke according to claim 4, the method comprising the step of:

adjusting each of inductances of said auxiliary coils.

12. A mis-convergence correction method for a color cathode-ray tube provided with said deflection yoke according to claim 5, the method comprising the step of:

adjusting each of inductances of said auxiliary coils.

13. A mis-convergence correction method for a color cathode-ray tube provided with said deflection yoke according to claim 6, the method comprising the step of:

adjusting each of inductances of said auxiliary coils.

14. A mis-convergence correction method for a color cathode-ray tube provided with said deflection yoke according to claim 7, the method comprising the step of:

adjusting each of inductances of said auxiliary coils.

* * * * *